United States Patent [19]

Couturier

[11] Patent Number: 4,778,441

[45] Date of Patent: Oct. 18, 1988

[54] INTERFOLDING MACHINERY IMPROVEMENT

[75] Inventor: Dennis Couturier, Washburn, Wis.

[73] Assignee: C.G. Bretting Manufacturing Co., Inc., Ashland, Wis.

[21] Appl. No.: 62,858

[22] Filed: Jun. 16, 1987

[51] Int. Cl.[4] ..... B31F 1/00

[52] U.S. Cl. ..... 493/425; 493/433; 270/39

[58] Field of Search ..... 493/425, 432, 433, 434, 493/435, 410, 418; 270/39, 40

[56] References Cited

U.S. PATENT DOCUMENTS

| | | | |
|---|---|---|---|
| 1,053,914 | 2/1913 | Hudson | 493/418 |
| 2,631,846 | 3/1953 | Sabee . | |
| 2,929,624 | 3/1958 | Brooker . | |
| 3,163,413 | 12/1964 | Franke et al. . | |
| 3,489,406 | 1/1970 | Nystrand . | |
| 3,572,681 | 3/1971 | Nystrand | 270/39 |
| 3,709,077 | 1/1973 | Trogan et al. | 83/152 |
| 4,070,014 | 1/1978 | Takahashi | 270/39 |
| 4,254,947 | 3/1981 | Trogan | 270/39 |
| 4,270,744 | 6/1981 | Trogan | 493/430 |
| 4,332,583 | 6/1982 | Stemmler et al. | 493/430 |
| 4,475,730 | 10/1984 | Trogan | 270/41 |
| 4,494,741 | 1/1985 | Fischer et al. | 270/39 |

FOREIGN PATENT DOCUMENTS 372031 3/1923 Fed. Rep. of Germany .

*Primary Examiner*—Frederick R. Schmidt
*Assistant Examiner*—Robert Showalter
*Attorney, Agent, or Firm*—Faegre & Benson

[57] ABSTRACT

An improvement for use in machinery for interfolding porous cut sheets is disclosed having two adjacent and counter-rotating folding rolls each having projecting tuckers and recessed grippers arranged alternately on the folding rolls such that a tucker on one roll mates with a gripper on the other. Porous cut sheets are selectively adhered to the folding rolls by vacuum ported to the tuckers and grippers.

6 Claims, 4 Drawing Sheets

INTERFOLDING MACHINERY IMPROVEMENT

BACKGROUND OF THE INVENTION

In the past, interfolding machinery has required the use of relatively complicated interfolding rolls to accomplish the interfolding of cut sheets from one or more webs of material to obtain a stack of interfolded products such as paper towels or facial tissues. Such prior art folding rolls required articulated mechanical grippers having a number of moving parts and requiring relatively complicated drive mechanisms to move such articulated parts at the proper times and to the proper positions to accomplish the interfolding. An example of such prior art mechanisms is shown in U.S. Pat. No. 4,270,744, entitled *Tuckers on Mechanical Folding Rolls,* the disclosure of which is incorporated by reference.

The present invention overcomes the relative complexity and associated cost and reliability problems of such prior art systems by providing interfolding rolls having vacuum tuckers and grippers which operate without moving parts to accomplish the interfolding of cut sheets of porous material, eliminating the need for complicated and sensitive drive mechanisms which were required to be coupled through the folding roll to actuate the mechanical grippers.

DETAILED DESCRIPTION

Figure 1:
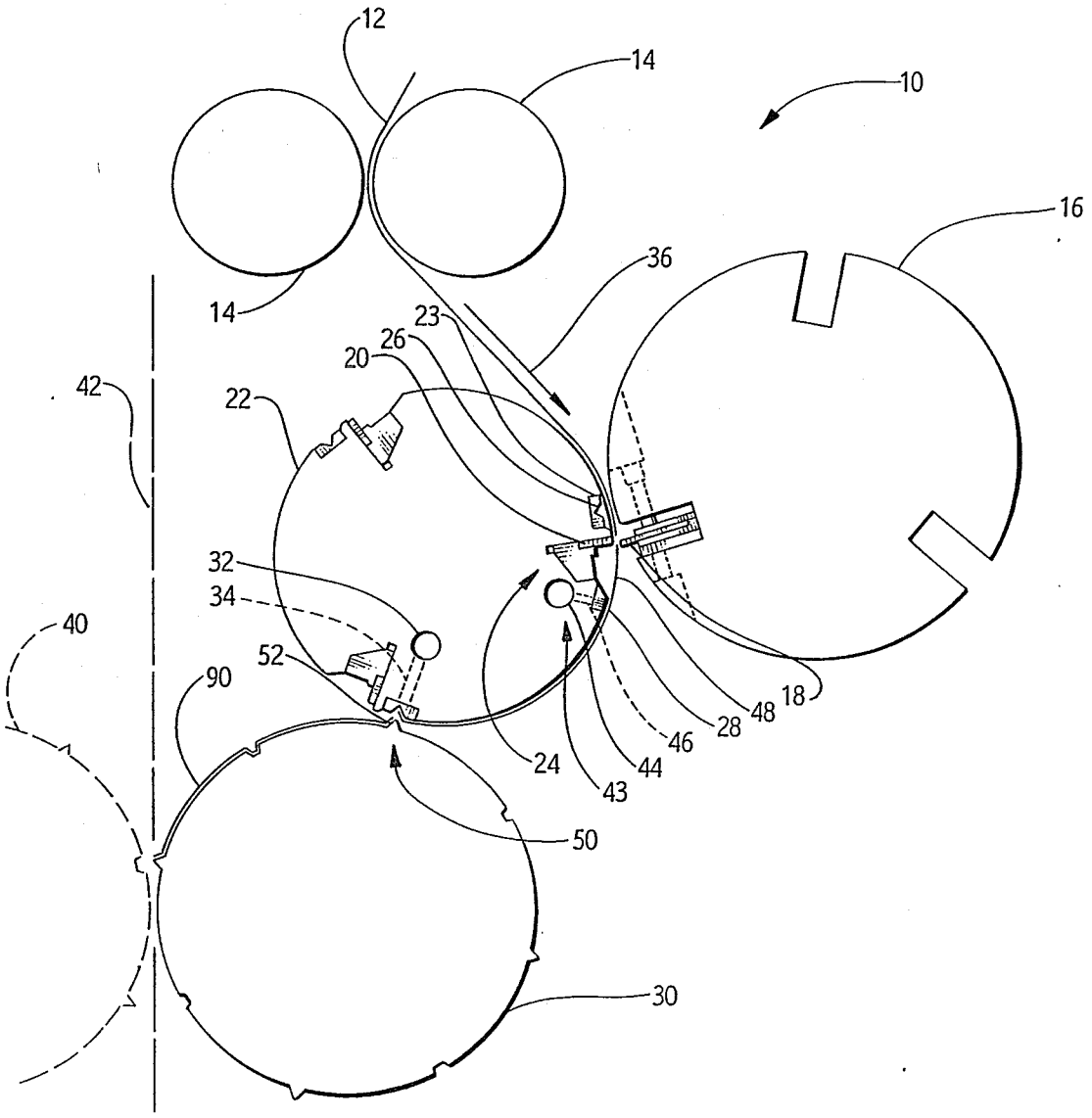
FIG. 1 shows a simplified view of a portion of interfolding machinery embodying certain aspects of this invention.

Referring now to FIG. 1, a simplified portion of interfolding machinery 10 may be seen. A web of porous material 12 is driven through the nip of a pair of folder feed rolls 14, driven by adjustable speed drives (not shown) to control or meter the feed rate or linear speed of web 12. A "nip" is the location between two adjacent rolls intersected by a line through both roll centers called the "nip centerline." A cutoff roll 16 transversely severs web 12 by the interengagement of a knife 18 and a knife anvil 20. Knife anvil 20 is located in a cutoff bedroll 22 at a cutoff station 24. Cutoff bedroll 22 has one or more plates 23 each carrying a vacuum ported notch 26 located a predetermined distance behind cutoff station 24. It is to be understood that rolls 16 and 22 preferably have a plurality of knives and anvils respectively and are synchronized to ensure proper interengagement of knives 18 with anvils 20. More detail of a cutoff anvil-knife combination suitable for this application may be found in U.S. Pat. No. 3,709,077 entitled *Cut-off Device,* the disclosure of which is incorporated by reference herein.

The folder feed rolls 14 feed web 12 to cutoff bedroll 22 at a linear speed slower than that of the surface speed of cutoff bedroll 22. The speed differential between web 12 and cutoff bedroll 22 maintains tension of web 12 during cutoff, and is set in connection with the position of notch 26 in plate 23 such that the leading edge of the cut web is positioned in notch 26 at the time of the next subsequent cutoff as illustrated by cut sheet 28. Vacuum is supplied to notch 26 through axial bore 32 and a plurality of radial passageways 34 in bedroll 22. Vacuum is switched to bore 32 by means of a manifold (not shown), but in a manner well known, as exemplified by U.S. Pat. No. 4,494,741, *Tissue Cutting and Interfolding Apparatus For Z Webs,* the disclosure of which is incorporated by reference. Vacuum is maintained on notch 26 from the time notch 26 passes the bedroll nip cutoff roll until it reaches the bedroll-folding roll nip 50.

The peripheral or circumferential location of notch 26 in bedroll 22 may be adjusted with respect to cutoff station 24 by replacing plate 23 with a new plate having notch 26 repositioned therein. The ability to adjust the position of notch 26 circumferentially permits accommodation of various degrees elasticity of different materials for web 12 to maintain the leading edge relationship of the cut web to the notch 26. This feature is especially useful in switching among various tissue type web materials which stretch different amounts in the direction of travel 36.

The cutoff bedroll 22 is also equipped with an air pressure station 43 ahead of the cutoff station 24 and having an axial bore 44 and radial passageways 46. Bore 44 and passageways 46 are selectively pressurized from approximately 30° ahead of a bedroll-folding roll nip 50 up to just before the nip 50. While pressurized, station 43 exhausts air generally radially from bedroll 22 to separate the trailing edge 48 of the cut sheet 28 from the bedroll 22 prior to edge 28 reaching the nip 50. This prevents trailing edge 48 from being trapped in cutoff station 24 and permits edge 48 to pass behind cutoff anvil or blade 20 as blade 20 passes the nip 50.

Cut sheet 28 is transferred from bedroll 22 to folding roll 30 at the bedroll-feedroll nip 50 by switching vacuum off in bore 32 and on in tucker 52 as they engage in nip 50.

It is to be understood that machinery 10 preferably has a second folding roll 40 (shown in phantom in FIG. 1) and furthermore folding roll 40 has its own cutoff roll and cutoff bedroll fed by a counterpart web, preferably located symmetrically about interfolding axis or centerline 42. Furthermore, machinery 10 may have additional rolls, such as idler rolls (not shown) to properly guide web 12 and its counterpart to the cutoff and interfolding rolls.

Figure 2:
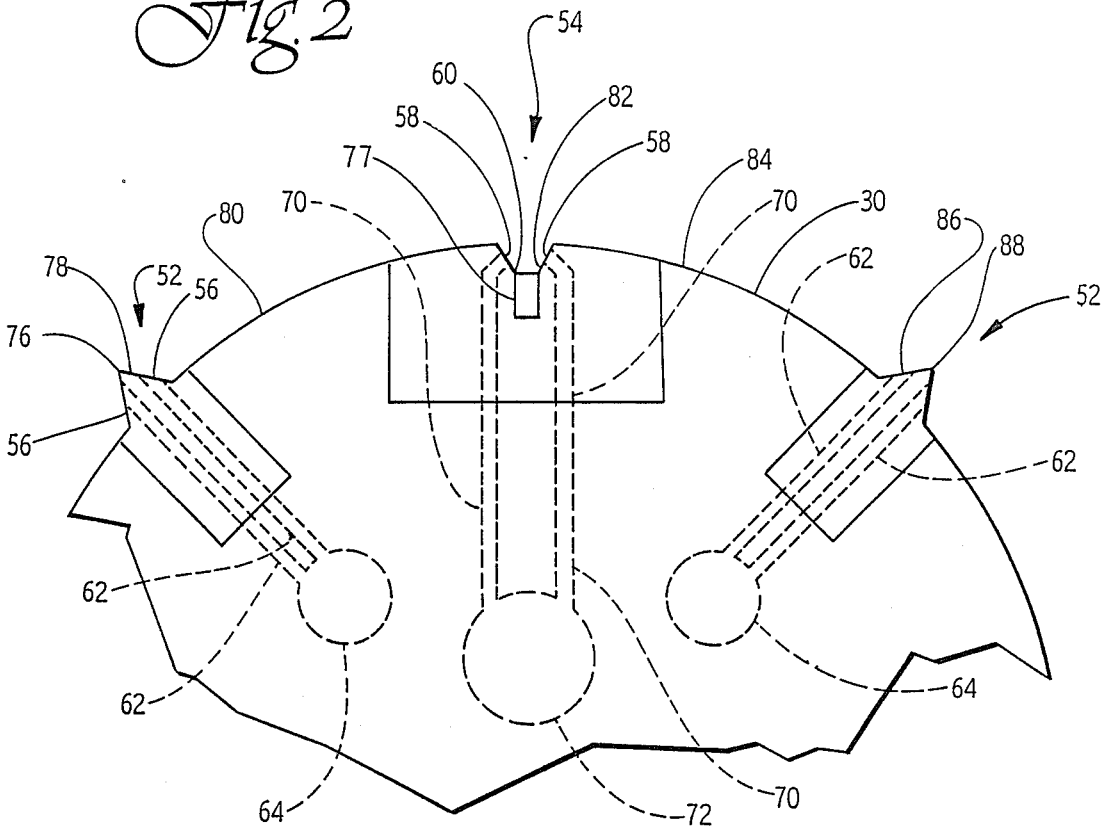
FIG. 2 shows a fragmentary simplified side elevation view of details of the folding roll used in this invention.
Figure 3:
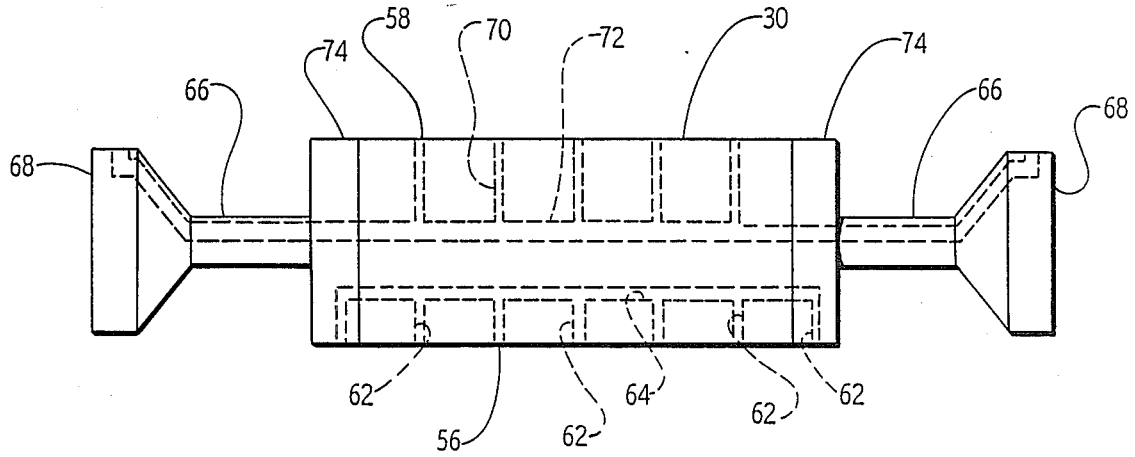
FIG. 3 shows a simplified transverse view of a folding roll illustrating vacuum manifold connections to a folding roll of this invention.

Referring now more particularly to FIG. 2, details of folding rolls 30 and 40 may be seen. Each of rolls 30 and 40 have projecting tuckers 52 and recessed grippers 54. Vacuum ports 56 are provided on the leading and trailing faces of each tucker 52. Each gripper 54 is formed as a transverse notch or groove 60 in each folding roll with vacuum ports 58 on the leading and trailing faces of notch 60. Vacuum ports 56 are connected by radial passageways 62 (which may be seen also in FIG. 3) to an axial bore 64 through each folding roll 30, 40 and extensions 66 to vacuum manifolds 68. Vacuum ports 58 are similarly connected through radially oriented passageways 70 to an axial bore 72 and vacuum manifolds 74. It is to be understood that manifold 68, 74 are stationary, while rolls 30, 40 and extensions 66 rotate about a common axis. As may be seen in FIG. 3, the vacuum ports 56 of tuckers 52 are separately valved from the vacuum ports 58 of the grippers 54 which allows independent timing for transfer and control of the cut sheets on the folding rolls.

Gripper 54 further has an elastic anvil 77 which cooperates with a tucker 52 on roll 40 at the folding rolls nip, forming a Resilient Creaser which is the subject of U.S. patent application Ser. No. 039,659, commonly assigned with the invention of this application, the disclosure of which is expressly incorporated by reference.

It is to be understood that the periphery of each of rolls 30, 40 is such that the distance from one tucker tip 76, along face 78, arc 80 of the circumference of roll 30, along the interior surface 82 of notch 60, along arc 84 and face 86 up to the tip 88 of the next tucker 52 is equal to the longitudinal dimension or length of a cut sheet 28 as measured in the direction of travel 36 through interfolding machinery 10.

The transfer of cut sheet 28 from bedroll 22 to folding roll 30 is as follows. When tucker 52 is engaged with notch 26 carrying the leading edge of cutsheet 28 (at the bedroll-folding roll nip 50), vacuum is off in bore 32, releasing the leading edge of sheet 28 from notch 26. Vacuum is turned on in the appropriate bore 64 at that time, applying vacuum to the tucker 52 then engaged with notch 26, causing the trailing edge of previous sheet 90 and the leading edge of sheet 28 to adhere to roll 30. As rotation of the bedroll 22 and folding roll 30 continues, vacuum is turned on in the gripper 54 next following the tucker 52 carrying the leading edge of sheet 28, after gripper 54 passes the nip 50, and preferably at top dead center to cause the center of sheet 28 to adhere to roll 30. Alternatively, another tucker-equipped roll (not shown) may be utilized to urge the center of sheet 28 into groove 60, either alone or in combination with vacuum applied to ports 58.

It is to be understood that transfer of cut sheets to folding roll 40 preferably occurs in a similar fashion.

Figure 4:
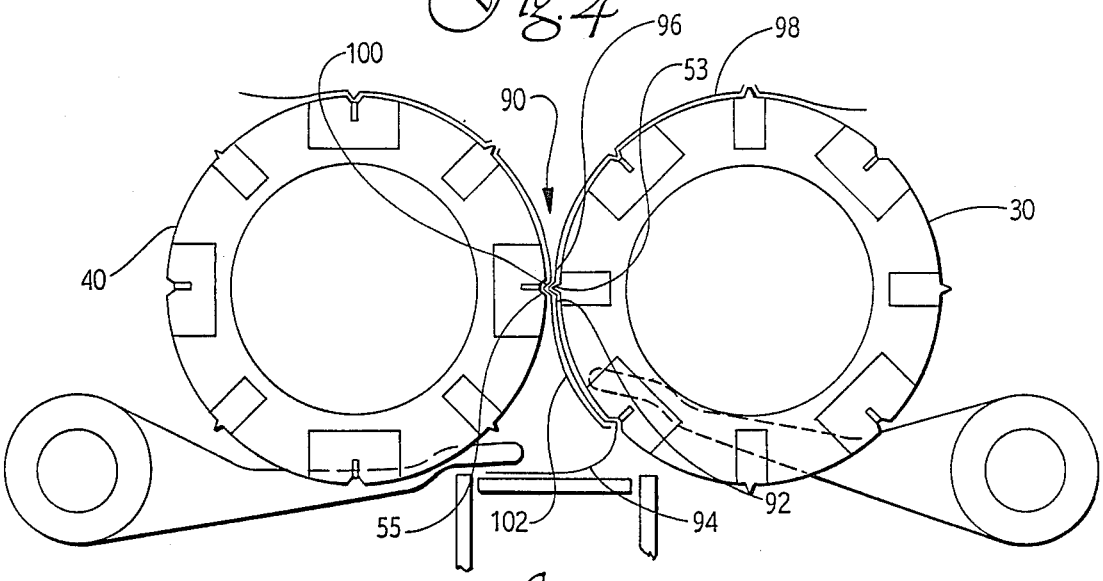
FIG. 4 shows a schematic view of the folding rolls and packer fingers at a first position beginning stack building.
Figure 5:
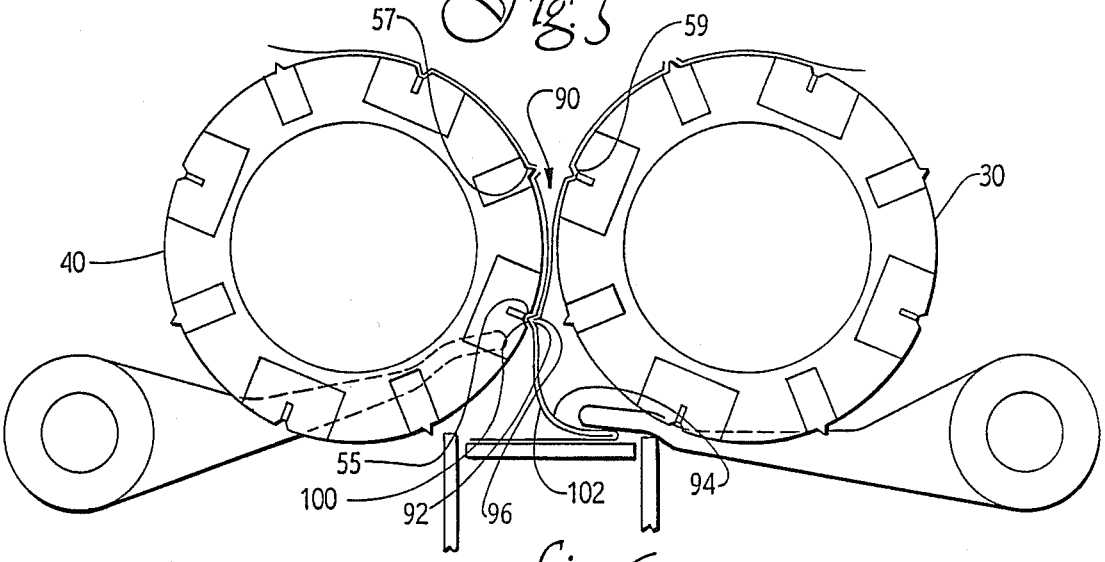
FIG. 5 shows the folding rolls at a second position continuing stack building.
Figure 6:
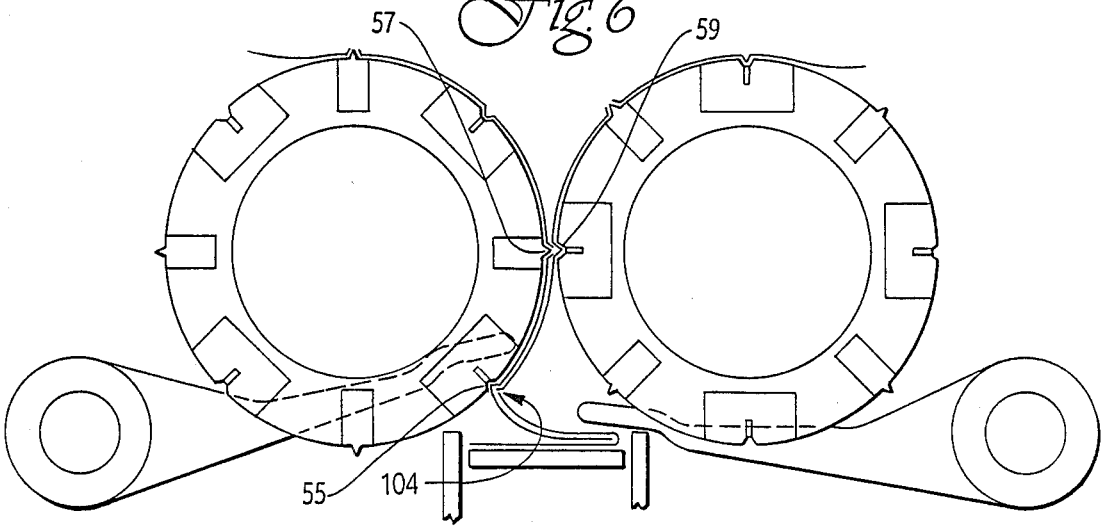
FIG. 6 shows the interfolding roll at a third position continuing stack building.
Figure 7:
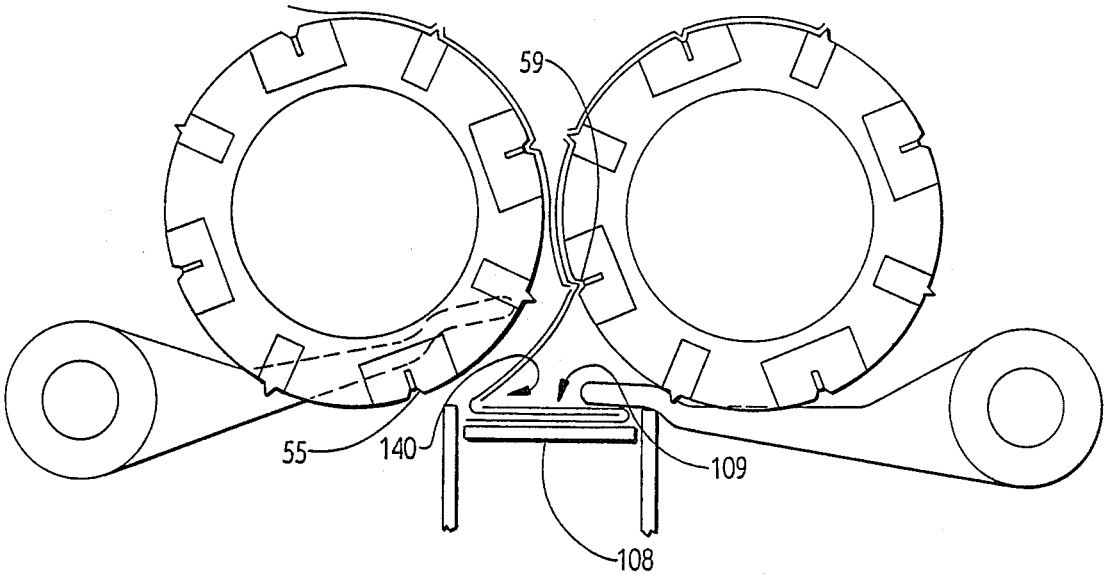
FIG. 7 shows the folding rolls at a fourth position continuing stack building.
Figure 8:
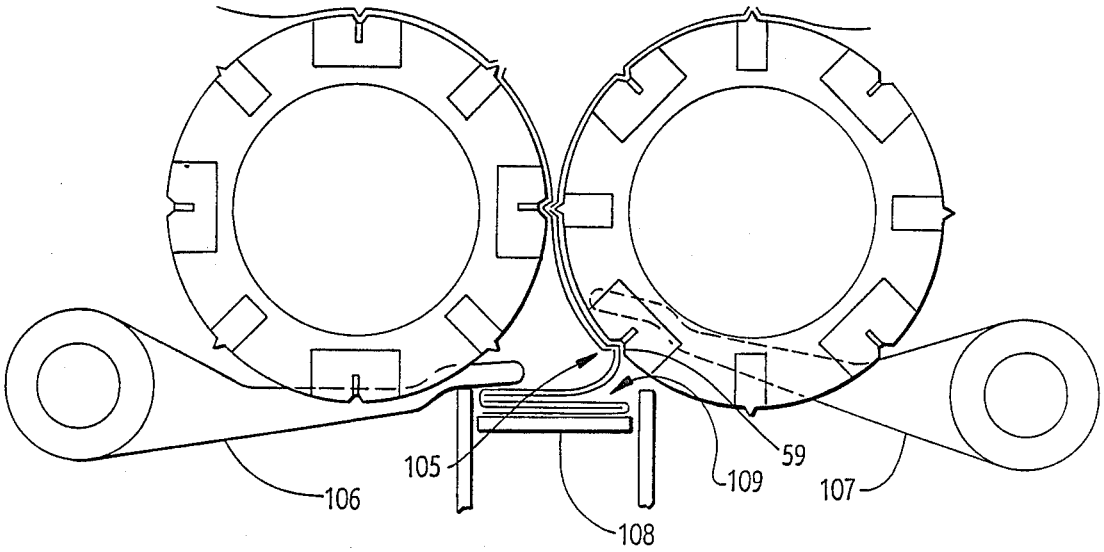
FIG. 8 shows the folding rolls in a fifth position corresponding to the first position as shown in FIG. 4 as stack building continues.

Referring now to FIGS. 4–8, the interfolding process will be described. In each of these figures, it is to be understood that folding roll 30 rotates counter clockwise, while folding roll 40 rotates clockwise. In FIG. 4 a tucker 53 on roll 30 mates with a gripper 55 on roll 40 at the folding rolls nip 90. Tucker 53 carries a trailing edge 92 of a first cut sheet (preferably a porous paper product) and further carries the leading edge 96 of a second cut sheet 98 while the leading gripper 55 carries a mediate portion (preferably the center) of a third cut sheet 102. As tucker 53 and gripper 55 pass the nip 90, vacuum is switched off tucker 53 and maintained in gripper 55, transferring leading and trailing edges 92, 96 to roll 40, as shown in FIG. 5. Vacuum is maintained on as rolls progress to the position shown in FIG. 6. After the interfold 104 formed by edges 92, 96 and mediate portion 100 passes the position shown in FIG. 6 and progresses to that shown in FIG. 7, vacuum is turned off in gripper 55, releasing interfold 104. More specifically, vacuum is switched off in the gripper 55 carrying the interfold 104 when the interfold reaches a point at which the distance between the gripper and its mating tucker equals one-half of the cut sheet length, which also (substantially) equals the width of a stack 109 of interfolded sheets. Packer finger 106 then comes down on interfold 104 to build stack 109. Returning now again to FIGS. 5–7, while interfold 104 is leaving nip 90, tucker 57 on roll 40 and gripper 59 on roll 30 are approaching nip 90. Vacuum is switched off tucker 57 as it reaches the position shown in FIG. 6, while vacuum is maintained on gripper 59 while it proceeds through the position shown in FIGS. 7 and 8, after which vacuum is removed from gripper 59, releasing interfold 105 to be placed on stack 109 by packer finger 107.

It has been found preferable to utilize a moveable elevator table 108 to build stack 109. Elevator table 108 forms a part of a Clip Separator, which is the subject of my co-pending U.S. patent application Ser. No. 040,546 filed Apr. 17, 1987 and assigned to the assignee of the invention of this application, the disclosure of which is expressly incorporated herein by reference.

The invention is not to be taken as limited to all of the details thereof as modifications and variations thereof may be made without departing from the spirit or scope of the invention.

What is claimed is:

1. An improvement for use in machinery for interfolding porous cut sheets comprising: two adjacent and counter-rotating folding rolls each having projecting tuckers and recessed grippers arranged alternately and timed such that a tucker on one folding roll mates with a gripper on the other folding roll in the folding rolls nip, wherein the mating tucker on one roll holds a trailing edge of a first cut sheet by vacuum means on its leading surface and a leading edge of a second cut sheet by vacuum means on its trailing surface and the mating gripper on the other roll carries a mediate portion of a third cut sheet by vacuum means such that the mediate portion of the third cut sheet is interfolded with the trailing edge of the first cut sheet and the leading edge of the second cut sheet as the cut sheets pass the folding rolls nip.

2. The improvement of claim 1 further comprising switchable vacuum connections interior of said folding rolls for selectively porting vacuum to the respective vacuum means on each of said tuckers and grippers for selectively adhering successive individual cut sheets to each folding roll from a predetermined point ahead of the folding rolls nip to the folding rolls nip.

3. The improvement of claim 2 wherein the folding roll periphery between successive tucker tips is substantially equal to the length of a cut sheet in the direction of travel through the interfolding machinery.

4. The improvement of claim 2 further comprising means to switch off vacuum in one folding roll from a tucker at the folding rolls nip to transfer the cut sheets then in the folding rolls nip to the other folding roll.

5. The improvement of claim 4 wherein the cut sheets are released from the other folding roll at a predetermined point after the folding rolls nip.

6. A method of interfolding porous web material comprising:

(a) rotating two adjacent folding rolls towards each other, each having projecting tuckers and recessed grippers arranged alternately and positioned such that a tucker on one roll engages a gripper on the other roll in the nip between the folding rolls;

(b) alternately feeding sheets cut from a web to the folding rolls ahead of the folding rolls nip such that each sheet is positioned on a folding roll with:

(i) a leading and trailing edge of that sheet retained by vacuum at successive tuckers on that folding roll, and (ii) a mediate portion of that sheet retained by vacuum at the gripper intermediate the leading and trailing edge retaining tuckers;

(c) removing vacuum from each tucker as it passes through the folding rolls nip such that the leading and trailing edges of sheets previously retained by that tucker are transferred from one folding roll to the other and subsequently retained by the engaging gripper on the other folding roll;

(d) removing vacuum from the engaging gripper after that gripper has passed the folding rolls nip; and (e) thereafter stacking the interfolded cut sheets.

* * * * *